United States Patent [19]

Tokuhara

[11] Patent Number: 4,457,616

[45] Date of Patent: Jul. 3, 1984

[54] VARIABLE MAGNIFICATION OPTICAL APPARATUS

[75] Inventor: Mitsuhiro Tokuhara, Chigasaki, Japan

[73] Assignee: Canon Kabushiki Kaisha, Tokyo, Japan

[21] Appl. No.: 344,798

[22] Filed: Feb. 1, 1982

[30] Foreign Application Priority Data

Feb. 12, 1981 [JP] Japan ..... 56-19509

[51] Int. Cl.[3] ..... G03G 15/04

[52] U.S. Cl. ..... 355/8; 355/11; 355/60; 355/66

[58] Field of Search ..... 355/8, 51, 55, 60, 11, 355/56, 57, 65, 66

[56] References Cited

U.S. PATENT DOCUMENTS

| | | | |
|---|---|---|---|
| 3,286,587 | 11/1966 | Hayden et al. | 355/57 |
| 4,116,562 | 9/1978 | Libby et al. | 355/60 |
| 4,129,379 | 12/1978 | Ogrisek et al. | 355/57 |
| 4,353,643 | 10/1982 | Statt | 355/11 X |

OTHER PUBLICATIONS

*IBM Technical Disclosure Bulletin,* vol. 15, No. 4, Sep. 1972, Portig, H., "Two-Mirror Copier Scanner."

*Research Disclosure,* Industrial Opportunities Ltd., England, No. 148, Aug. 1976, p. 12, 14820, Day, P. B., "Size Reduction Imaging Means."

*Primary Examiner*—J. V. Truhe

*Assistant Examiner*—J. Pendergrass

*Attorney, Agent, or Firm*—Fitzpatrick, Cella, Harper & Scinto

[57] ABSTRACT

A variable magnification optical apparatus for projecting an image at a first plane onto a second plane includes an optical system for forming an image of the first plane on the second plane, a first mirror disposed between the image-forming optical system and the first plane and a second mirror disposed between the image-forming optical system and the second plane. When the magnification is changed, the first mirror is rotated by a determined angle of $\theta$ and the second mirror is moved in a determined direction while rotating also by the same angle $\theta$. The image-forming optical system is moved in the direction along its optical axis and is rotated by an angle two times larger than the rotation angle $\theta$ of the first mirror at the same time.

2 Claims, 4 Drawing Figures

VARIABLE MAGNIFICATION OPTICAL APPARATUS

BACKGROUND OF THE INVENTION

1. Field of the Invention

The present invention relates to a variable magnification optical unit useful for the slitwise exposure type copying machine and other similar image forming apparatus.

2. Description of the Prior Art

In an optical apparatus in which the object plane and the image plane are fixed and a fixed focus lens is used as the lens system to form an image of the object plane on the image plane there is a problem in changing the magnification of the focused image. In such optical apparatus, the magnification change is generally achieved by shifting the focusing (image-forming) lens system along its optical axis. However, when the focusing lens system is moved, it is required to maintain the optically conjugated relation between the object plane and the image plane with respect to the focusing lens system. To provide the variable magnification facility, therefore, the problem is in how to maintain the conjugated relation between the object plane and the image plane while shifting the focusing lens system.

A solution to the problem according to the prior art is disclosed in Japanese Utility Model Application Publication No. 12,464/1965. According to the known solution, the optically conjugated relation between the object plane and the image plane is maintained by shifting mirrors provided on the object space side when the focusing lens system is moved for magnification change. Concrete arrangements of such variable magnification optical apparatus according to the prior art are shown in FIGS. 1 and 2 for the purpose of illustration.

In the arrangement shown in FIG. 1, there are provided mirrors 1 and 2 for correcting the optical path length. When the magnification is changed, the mirrors 1 and 2 are shifted in the directions of arrows $A_1$ and $B_1$ respectively by the same distance without changing the principal optical path, and the lens 3 is shifted to the position 3' along the optical axis. Mirrors 4 and 5 are used to deflect the optical path and to obtain the space for the photosensitive medium 7. The use of deflecting mirrors 4 and 5 serves to reduce the horizontal size of the whole apparatus. The image of an original 6 is projected slitwise on the photosensitive drum 7 through the optical system.

In the arrangement shown in FIG. 2 there are provided mirrors 8 and 9 for correcting the optical path length. When the magnification is changed, the mirrors 8 and 9 are shifted in the direction of arrow $A_2$ and the lens 3 is shifted to the position 3' along the optical axis. Mirrors 10 and 11 are stationary mirrors for deflecting the optical path.

Another solution to the above problem is disclosed in Japanese Patent Application Laid-Open No. 9,436/1977. According to the solution, mirrors are provided on the image space side of the focusing lens system. With the movement of the focusing lens system for changing the magnification, these mirrors are also moved to change the optical path length between the object plane and the image plane thereby maintaining the optically conjugated relation between the two planes with respect to the focusing lens system. More concretely, two mirrors are provided on the image space side of the focusing lens system. When the magnification is changed, one of the two mirrors is rotated by a certain determined angle of $\theta$. The other mirror is not only rotated by the same angle $\theta$ but also shifted translationally in a determined direction. Under the cooperative action of these two mirrors, the optical path length between the object plane and the image plane is changed while maintaining constant the incident optical path and the exit optical path of the beam to and from the two mirrors.

However, the above described known optical apparatus provided with the variable magnification facility have some drawbacks. In the prior art apparatus, the correction of the optical path length between the object plane and the image plane as required when the single focus image-forming optical system is moved along the optical axis, is achieved by a group of mirrors which are particularly provided on the object space side or on the image space side of the image-forming optical system. This means that within the apparatus there are always present other mirrors which are never contributable to the necessary correction of the optical path length. For the transfer type of copying machine it is required to form a mirror image of the original in the object plane on the photosensitive medium which is the image plane. If mirrors for deflecting the optical path are used in the apparatus to realize a compact construction of the apparatus, there are needed not an odd number but an even number of mirrors in the optical path as a whole. Therefore, in the variable magnification optical apparatus according to the prior art there were required at least four mirrors in total. To realize a compact construction of the apparatus a further number of mirrors were generally needed in addition to the four mirrors.

Although the compactness of the apparatus can be further improved with increasing the number of mirrors for deflecting the optical path, this brings about another problems of cost increase and more difficult optical adjustment. In this point of view it is desirable that the number of mirrors which are not contributable to the correction of the optical path length should be as small as possible.

SUMMARY OF THE INVENTION

Accordingly it is an object of the present invention to provide a variable magnification optical apparatus having a novel mechanism for varying the magnification.

It is another object of this invention to provide such variable magnification optical apparatus which enables to minimize the number of mirrors necessary for the apparatus.

To attain the above objects according to the invention there is provided novel arrangement of the variable magnification optical apparatus in which both of the mirrors arranged on the object space side and on the image space side of the image-forming optical system are contributable to the correction of the optical path length.

The novel arrangement of the variable magnification optical apparatus comprises a first mirror disposed on the object space side of an image-forming optical system and a second mirror disposed on the image space side of the image-forming optical system. At the magnification change, the first mirror rotates by an angle of $\theta$ and at the same time the second mirror rotates by the same angle of $\theta$. At this time, the image-forming optical system arranged between the first and second mirrors rotates by $2\theta$ and also translationally moves in the direction along the optical axis for changing the magnification. Further, at least one of the first and second mirrors moves translationally along the optical axis while rotating by the angle of $\theta$. With the novel arrangement, the correction of the optical path length required at the magnification change can be achieved by the minimum number of mirrors. In an embodiment of the invention where the smallest number of mirrors are used, there are provided only two mirrors one of which is on the front side of the image-forming optical system and the other one is on the rear side thereof.

Other and further objects, features and advantages of the invention will appear more fully from the following description taken in connection with the accompanying drawings.

DESCRIPTION OF PREFERRED EMBODIMENTS

Figure 1:
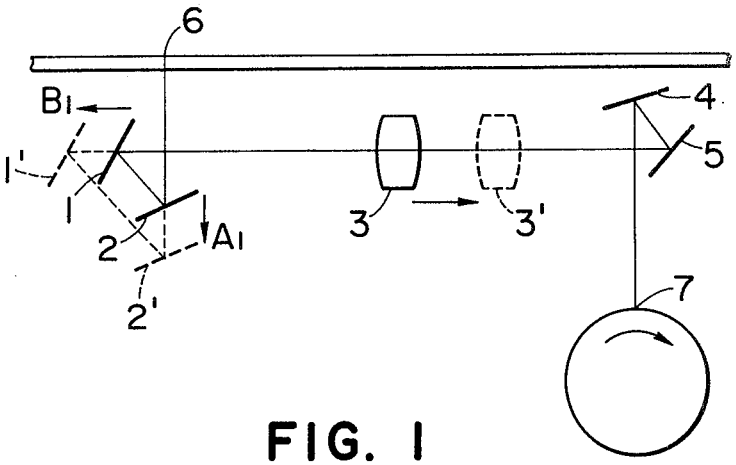
FIG. 1 PRIOR ART
FIGS. 1 and 2 are schematic views of copying apparatus showing the arrangements of variable magnification optical system according to the prior art.
Figure 2:
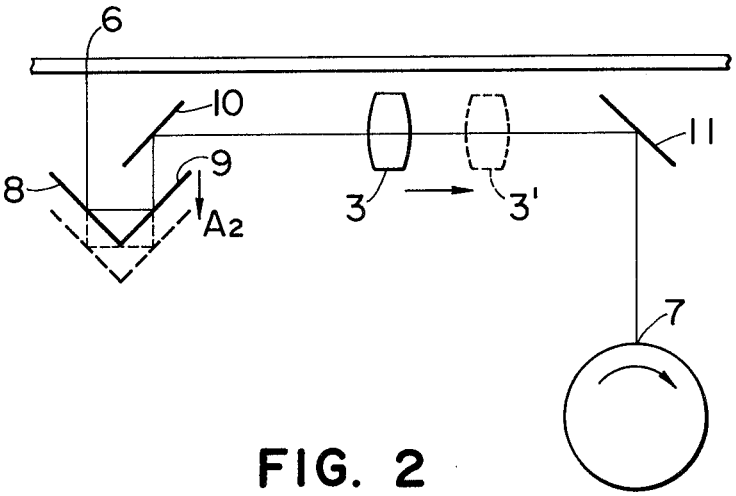
FIG. 2 PRIOR ART
Figure 3:
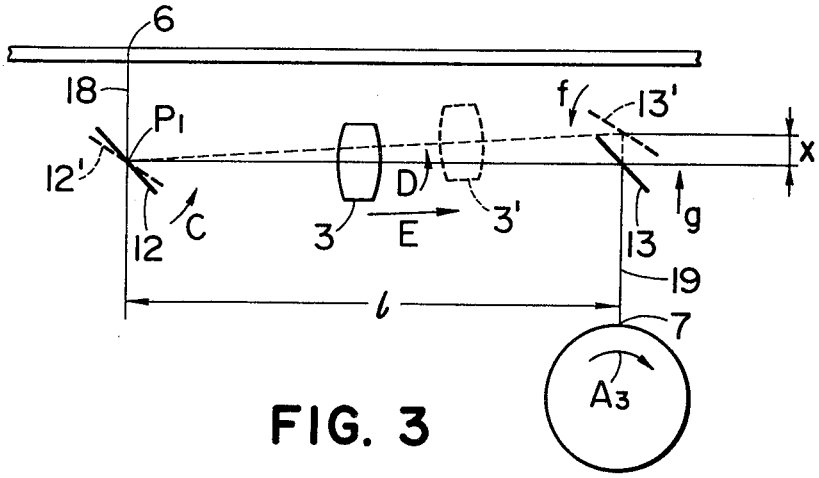
FIGS. 3 and 4 are schematic views of copying apparatus showing the arrangements of variable magnification optical system according to the present invention.

FIG. 3 shows an embodiment of the present invention in which the arrangement of variable magnification optical system according to the invention has been applied to a slitwise copying machine of the type in which the original plane is moved.

In FIG. 3, reference numeral 6 depicts an original to be copied. At one-to-one magnification, the light from a slit area of the original 6 is at first deflected by a mirror 12 at right angles so as to make the light running in nearly parallel with the original plane. After passing through an image-forming lens 3, the light is again deflected by a second mirror 13 toward a photosensitive medium 7 in the form of a drum rotating in the direction of arrow $A_3$. Thus, the light coming from the slit area of the original is projected on the corresponding slit area of the photosensitive medium 7.

When the magnification is changed, the mirror 12 is rotated by an angle of $\theta$ about its reflection point $P_1$ at which the mirror surface and the optical axis intersect each other. The reference character C indicates the direction in which the mirror 12 is rotated by $\theta$. At the same time, the lens 3 is rotated by $2\theta$ about the point $P_1$ in the direction of arrow D while being shifted in the direction of arrow E. The second mirror 13 is rotated by $\theta$ in the direction of arrow f while being shifted by a distance X in the direction of g that is the same direction as the optical axis of the exit optical path 19.

Let l denote the distance between the incidence optical path and the exit optical path, f the focal length of the lens, $\beta$ the magnification then used and $\Delta$ the change of the optical path length for the magnification change to $\beta$. Then, $$\Delta = \sqrt{l^2 + X^2} + X - l \quad (1)$$

$$= f \times \frac{(1+\beta)^2}{\beta} - 4f \quad (2)$$

$$X = l\tan 2\theta \quad (3)$$

Rearrangement of the above equations (1), (2), (3) gives:

$$f \times \frac{(1-\beta)^2}{\beta} = l \times \frac{2\tan\theta}{1-\tan\theta} \quad (4)$$

From the equation (4) it is understood that the desired magnification $\beta$ can be obtained, for instance, by altering the rotation angle $\theta$.

At the magnification change, the slit area of the original 6 is projected on the corresponding slit area of the photosensitive medium 7 rotating in the direction of arrow $A_3$ through the first mirror now in the position 12', the lens now in the position 3' and the second mirror now in the position 13'. In the same manner as above, the image light from the slit area of the original is deflected at first by the first mirror 12' and then by the second mirror 13' after passing through the lens 3'. Although the magnification is changed, the incidence optical path 18 and the exit optical path 19 remain fixed. The number of mirrors required for this arrangement is only two. Therefore, there can be obtained the variable magnification apparatus which is low in manufacturing cost and very compact in construction.

In the above embodiment, the second mirror 13 provided on the object space side of the lens 3 has been moved translationally along the optical axis of the exit optical path 19 to change the optical path length between the original plane 6 and the photosensitive medium 7. However, in order to change the optical path length between the original plane 6 and the photosensitive medium 7, not the second mirror 13 but the first mirror 12 may be shifted translationally. In this case, the lens 13 is fixed against translational movement and is only rotated by $\theta$. The lens 12 provided on the object space side of the lens 3 is shifted by a distance of X along the optical axis of the incidence optical path 18 while being rotated by the same angle of $\theta$. As a further modification of the above shown embodiment, both of the mirrors 12 and 13 may be mounted for translational movement. In this case, the necessary change of the optical path length between the original plane 6 and the photosensitive medium 7 can be attained by moving the mirror 12 along the optical axis of the incidence optical path 18 and the mirror 13 along the optical axis of the exit optical path 19 while rotating both of the mirrors 12 and 13 by $\theta$. This modification makes it possible to reduce the distance moved by the mirrors 12, 13 as compared with the above embodiment where one of the two mirrors 12 and 13 is translationally moved in the determined direction.

When the lens system 3 is in the position for one-to-one magnification, the optical path length between the original plane 6 and the photosensitive medium 7 is the minimum path length. Therefore, when the magnification is changed from one-to-one reduction to another for minification or enlargement, the direction in which the mirror 12 and 13 are to be rotated is determined, as a matter of course, in such manner that the optical path length between the original plane 6 and the photosensitive medium 7 can be made larger by the translational movements of the mirror. The direction in which the lens 3 is to be shifted depends on whether the magnification is for reduction or for enlargement. If the position which the lens 3 takes for one-to-one magnification is referred to as reference position, then the lens 3 must be moved toward the image space side from the reference position when a reduction copy is required. When an enlargement is required, the lens 3 is to be moved toward the object space side from the reference position.

Figure 4:
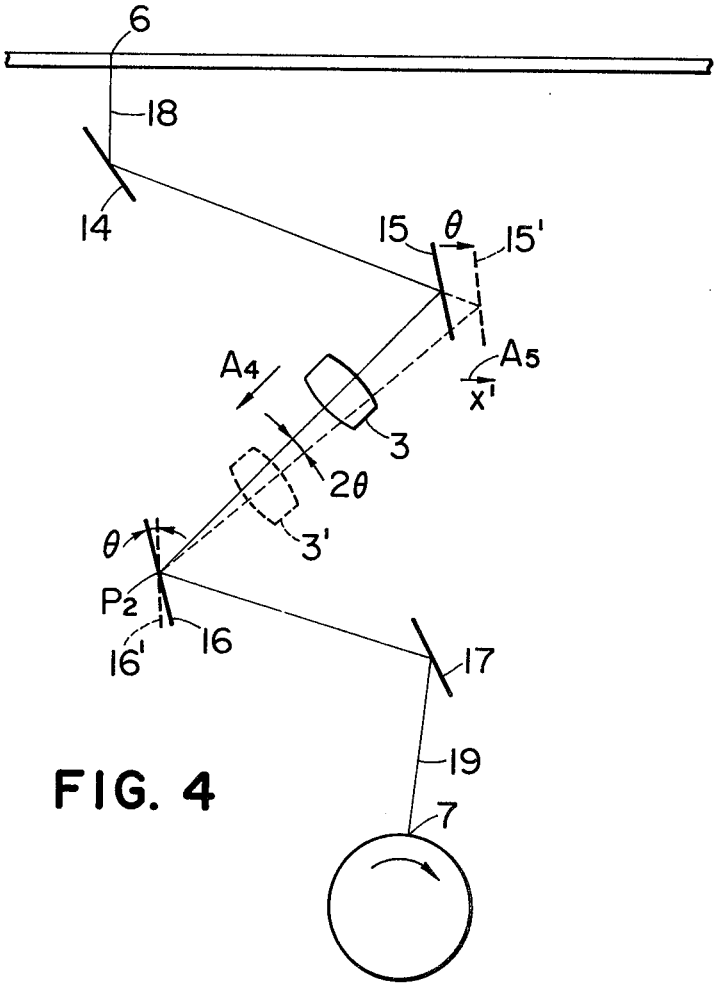

FIG. 4 shows another embodiment of the invention where the variable magnification optical system according to the present invention has also been applied to a slitwise copying machine of the type in which the original plane is moved.

The embodiment in FIG. 4 includes four mirrors 14, 15, 16 and 17 for the purpose of a compact design of the apparatus in the horizontal size.

The light from every slit area of the original 6 is deflected at first by the mirror 14 and then by the mirror 15 to the lens 3. After passing through the lens 3, the light is further deflected by the mirrors 16 and 17 toward the photosensitive medium 7. In this manner, an image of the original 6 is slitwise projected on the photosensitive medium 7 through the lens 3 while being deflected four time. In FIG. 4, the solid line indicates the position for one-to-one magnification.

When the magnification is changed, the mirror 16 is rotated by $\theta$ to take the position 16' suggested by the phantom line. At the same time, the lens 3 is rotated by $2\theta$ about the point $P_2$ at which the mirror 16 and the optical axis intersect each other while being translationally shifted in the direction of arrow $A_4$. Also, the mirror 16 is shifted in the direction of arrow $A_5$ by a determined distance X' while rotating by $\theta$. The distance X' moved by the mirror 15 corresponds to the distance X previously mentioned in connection with the first embodiment.

As readily understood from the foregoing, the optical system according to the invention can be applied to a copying machine with advantages over the prior art. When the variable magnification optical system according to the invention is used in a copying machine of the type in which the original is moved, the number of mirrors to be provided in the optical system can be reduced to only two. While the invention has been particularly shown and described with reference to the original moving type of the copying machine in which the present invention has been embodied, it is to be understood that the optical system according to the invention can be used also as a variable magnification optical system for another type of copying machine in which the original remains stationary.

In the novel arrangement of the variable magnification optical system according to the invention, the mirrors between which a focusing optical system is arranged perform the function to correct the optical path length at magnification change. Therefore, the apparatus according to the present invention is compact in construction and easy to manufacture as compared with the prior art apparatus.

What I claim is:

1. An optical apparatus for projecting an image in a first plane onto a second plane and provided with variable magnification means comprising:

an optical system for forming an image of the first plane on the second plane;

a first mirror disposed between the first plane and said image-forming optical system and rotatable, at a fixed position, by a determined angle $\theta$ upon a change of magnification;

a second mirror disposed between said image-forming optical system and the second plane and rotatable by the same rotation angle $\theta$ as said first mirror upon a change of magnification while at the same time translationally moving in a determined direction; and wherein said image-forming optical system is rotated by an angle two times larger than the rotation angle $\theta$ of said first mirror and is also translationally moved along its optical axis when the magnification is changed.

2. An optical apparatus for projecting an image in a first plane onto a second plane and provided with variable magnification means comprising:

an optical system for forming an image of the first plane on the second plane;

a first mirror disposed between said image-forming optical system and the first plane and rotatable by a determined angle $\theta$ upon a change of magnification while at the same time translationally moving in a determined direction;

a second mirror disposed between said image-forming optical system and the second plane and rotatable, at a fixed position, by the same angle as the rotation angle $\theta$ of said first mirror upon a change of magnification; and wherein said image-forming optical system is rotated by an angle two times larger than the rotation angle $\theta$ of said first mirror and is also translationally moved along its optical axis when the magnification is changed.

* * * * *